US008629785B2

(12) United States Patent
Ni

(10) Patent No.: US 8,629,785 B2
(45) Date of Patent: Jan. 14, 2014

(54) METHOD AND SYSTEM FOR TRAFFIC RESOURCE ALLOCATION

(76) Inventor: Jiantong Ni, Guangzhou (CN)

( * ) Notice: Subject to any disclaimer, the term of this patent is extended or adjusted under 35 U.S.C. 154(b) by 39 days.

(21) Appl. No.: 13/486,314

(22) Filed: Jun. 1, 2012

(65) Prior Publication Data

US 2013/0321173 A1 Dec. 5, 2013

(51) Int. Cl.
*G08B 21/00* (2006.01)
*E01C 1/00* (2006.01)

(52) U.S. Cl.
USPC ..... 340/907; 340/916; 340/918; 340/925; 404/1

(58) Field of Classification Search
USPC ..... 340/907, 909, 916–919, 925; 404/1, 72
See application file for complete search history.

(56) References Cited

U.S. PATENT DOCUMENTS 3,106,695 A * 10/1963 Baltayan et al. ..... 340/916
5,283,573 A * 2/1994 Takatou et al. ..... 340/937
5,530,441 A * 6/1996 Takatou et al. ..... 340/937
7,491,009 B1 * 2/2009 Remy ..... 404/1
7,905,681 B2 * 3/2011 Remy ..... 404/72
2008/0284616 A1 * 11/2008 Rendon ..... 340/907
2009/0052983 A1 * 2/2009 Goj ..... 404/1

* cited by examiner

*Primary Examiner* — Van T. Trieu

(57) ABSTRACT

A traffic resource allocation method is provided for allocating traffic resources around an intersection formed by a first road and a second road. The method includes dividing the first road into two or more first lanes at a first direction and two or more second lanes at a second direction opposite but parallel to the first direction. The method also includes dividing the second road into two or more third lanes at a third direction and two or more four lanes at a fourth direction opposite but parallel to the third direction. Further, the method includes controlling traffic movements in the intersection by allocating traffic permit to both pedestrian traffic and vehicle traffic on the first road and the second road. The method also include, when permitting pedestrian traffic along the first direction and the second direction, permitting through vehicle traffic along the first direction and the second direction, and prohibiting turn traffic at any of the first, second, third, and fourth directions.

24 Claims, 17 Drawing Sheets

METHOD AND SYSTEM FOR TRAFFIC RESOURCE ALLOCATION

FIELD OF INVENTION

The invention relates to traffic control technologies in general and, more particularly, to methods and systems for traffic resource allocation at an intersection.

BACKGROUND

To ensure safety and efficiency of transportation, the traffic must be organized, especially in cities and towns where there is large volume of traffic needs. The control of traffic at intersections, where two or more roads either meet or cross, is essential to the organization of traffic in populated areas. The control is usually achieved by a signal-controlled system to allocate the time to indicate which traffic is allowed to proceed using traffic signals, usually electric. The performance of such system is responsible for the safety and efficiency of traffic in cities and towns.

FIG. 1 shows a traditional traffic allocation system 100. As shown in FIG. 1, when two roads AB and XY intersect, traffic needs to be controlled along four directions: AB, BA, XY, and YX. For each traffic direction, there are both through traffic and turn traffic (including left turn, right turn, and U turn). Thus, for two four-lane roads, AB and XY, with two lanes at each direction crossing at an intersection, the traditional system 100 allocates through traffic and right turn traffic to the curb lane using a through and right turn traffic marking 102, and through traffic and left turn traffic to the inner lane using a through and left turn traffic marking 104.

In addition to the allocation of space in terms of lanes, FIG. 2 shows an allocation of passing permit in the AB and XY intersection. As shown in FIG. 2, the traditional system uses four phases to direct the traffic movement in the intersection. Each traffic signal is represented by a number of letters and numbers, from left to right. The first letter (A, B, X, Y) represents the road on which the traffic signal controls the traffic movement. The second number indicates a traffic pattern, with number one ("1") indicating a through traffic, and number two ("2") indicating various turn traffics. The third letter, which follows the number (e.g., 2), further indicates the direction of the turn traffic, with U meaning U turn, L meaning left turn, and R meaning right turn. For example, A1 controls the through traffic on Road A, and X2L controls the left turn traffic on Road X.

There are 4 phases of traffic passing permit as shown in FIG. 2. During the first phase, the lights controlling the various traffics from Road A (A1, A2U, A2L, A2R) are green and other lights are red. During the second phase, the lights controlling the various traffics from Road B (B1, B2U, B2L, B2R) are green and other lights are red. During the third phase, the lights controlling the various traffics from Road X (X1, X2U, X2L, X2R) are green and other lights are red. During the fourth phase, the lights controlling the various traffics from Road Y (Y1, Y2U, Y2L, Y2R) are green and other lights are red. FIGS. 3-6 illustrate traffic movements corresponding to the various phases. Although the U turn traffic is also included in FIG. 2, U turn traffic is in general not permitted in a two-lane setting and is thus omitted in FIGS. 3-6.

FIG. 3 illustrates the traffic movements in the first phase of the traditional system, including pedestrian traffic 108, vehicle through traffic 110, vehicle right turn traffic 112, and vehicle left turn traffic 114. A1, A2, B1, B2, X1, X2, Y1, and Y2 are the traffic lights in the system for corresponding lanes.

All the vehicle traffics on Road A, including the through traffic 110, and turn traffic 112 and 114, are permitted to proceed, while no vehicle is permitted to pass through the intersection from other roads. The pedestrian traffics 108 on both Roads AB and XY are possible but limited to half of the pedestrian crossing line 106 and the pedestrians are forced to stop in the middle of the cross line to avoid conflict with passing vehicles. Traffic accident is likely to occur if pedestrian proceeds into the vehicle pathway 112 or 114. Thus, both the pedestrian and the driver in the turning vehicle would have to reduce their speed to observe other traffics to avoid accident. In some jurisdictions, vehicles on Road B, X and Y are allowed to turn right even under the red light, further increasing the risk of collision between vehicles and pedestrians.

FIG. 4 illustrates the traffic movements in the second phase of the traditional system, including pedestrian traffic 108, vehicle through traffic 110, vehicle right turn traffic 112, and vehicle left turn traffic 114. All the vehicle traffic on Road B, including the through traffic 110 and turn traffic 112 and 114, are permitted to proceed, while no vehicle is permitted to pass through the intersection from other roads. The pedestrian traffics 108 on both Roads AB and XY are possible but limited to half of the pedestrian crossing lines 106 and the pedestrians are forced to stop in the middle of the cross line to avoid conflict with passing vehicles. Traffic accident is likely to occur if pedestrian proceeds into the vehicle pathway 112 or 114. Thus, both the pedestrian and the driver in the turning vehicle would have to reduce their speed to observe other traffics to avoid accident. In some jurisdictions, vehicles on Road A, X and Y are allowed to turn right even under the red light, further increasing the risk of collision between vehicle and pedestrian.

FIG. 5 illustrates the traffic movements in the third phase of the traditional system, including pedestrian traffic 108, vehicle through traffic 110, vehicle right turn traffic 112, and vehicle left turn traffic 114. All the vehicle traffics on Road X, including the through traffic 110 and turn traffic 112 and 114, are permitted to proceed, while no vehicle is permitted to pass through the intersection from other roads. The pedestrian traffics 108 on both Roads AB and XY are possible but limited to half of the pedestrian crossing lines 106 and the pedestrians are forced to stop in the middle of the cross lines to avoid conflict with passing vehicles. Traffic accident is likely to occur if pedestrian proceeds into the vehicle pathway 112 or 114. Thus, both the pedestrian and the driver in the turning vehicle would have to reduce their speed to observe other traffics to avoid accident. In some jurisdictions, vehicles on Road A, B and Y are allowed to turn right even under the red light, further increasing the risk of collision between vehicle and pedestrian.

FIG. 6 illustrates the traffic movements in the fourth phase of the traditional system, including pedestrian traffic 108, vehicle through traffic 110, vehicle right turn traffic 112, and vehicle left turn traffic 114. All the vehicle traffics on Road Y, including the through traffic 110, and turn traffic 112 and 114, are permitted to proceed, while no vehicle is permitted to pass through the intersection from other roads. The pedestrian traffics 108 on both Roads AB and XY are possible but limited to half of the pedestrian crossing lines 106 and the pedestrians are forced to stop in the middle of the cross line to avoid conflict with passing vehicles. Traffic accident is likely to occur if pedestrian proceeds into the vehicle pathway 112 or 114. Thus, both the pedestrian and the driver in the turning vehicle would have to reduce their speed to observe other traffics to avoid accident. Therefore, there are conflicts in all of the four phases of traffic movements.

FIG. 7 illustrates another traditional traffic system 200. As shown in FIG. 7, Road AB is now an eight-lane road, with four lanes for each direction. The curb lane (the right lane) is used for right turn traffic with a right turn marking 116; the innermost lane is used for left turn and U turn with a left and U turn marking 120; and the two inner lanes between the curb lane and innermost lane are used for through traffic with a through traffic markings 118. That is, if there are three or more lanes (Road AB), left turn traffic may take the left lane, right turn traffic may take the right lane, and through traffic may take the middle lane(s). For a two-lane road, U turn traffic is generally not permitted.

The same problems of traffic movement conflicts as previously described similarly exist in the traditional system 200 as shown in FIG. 7. For example, when the traffic on Road A is permitted to proceed, the through traffic, left turn traffic, right turn traffic, and U turn traffic are permitted to proceed, while no vehicle is permitted to pass through the intersection from other roads. The pedestrian traffics on both Road AB are possible but limited to half of the pedestrian crossing lines 106 and the pedestrians are forced to stop in the middle of the cross lines to avoid conflict with passing vehicles. Similarly, traffics on Road B, X, and Y are having the same traffic conflicts.

Therefore, as described in the preceding paragraphs, the traditional traffic allocation system is both unsafe and inefficient. Because pedestrians cross the road while vehicle traffics, including turn traffics, proceed, it is likely that pedestrian and vehicle traffic could enter the same space at the same time to cause collision. Both pedestrian and vehicles in the intersection are required to reduce their speed to observe other traffics to avoid accident. Lower speed in passing the intersection reduces the efficiency of the whole traffic system. In addition, U turn in the system is sometimes not allowed because it would significantly increase the risk of traffic accident.

The disclosed systems and methods are directed at solving one or more problems set forth above and other problems.

BRIEF SUMMARY OF THE DISCLOSURE

One aspect of the present disclosure provides a traffic resource allocation method for allocating traffic resources around an intersection formed by a first road and a second road. The method includes dividing the first road into two or more first lanes at a first direction and two or more second lanes at a second direction opposite but parallel to the first direction. The method also includes dividing the second road into two or more third lanes at a third direction and two or more fourth lanes at a fourth direction opposite but parallel to the third direction. Further, the method includes controlling traffic movements in the intersection by allocating traffic passing permit to both pedestrian traffic and vehicle traffic on the first road and second road. The method also includes, when permitting pedestrian traffic along the first direction and the second direction, permitting through vehicle traffic along the first direction and the second direction, and prohibiting turn traffic at any of the first, second, third, and fourth directions.

Another aspect of the present disclosure provides a traffic system for allocating traffic resources around an intersection formed by a first road and a second road. The first road is divided into two or more first lanes at a first direction and two or more second lanes at a second direction opposite but parallel to the first direction, and the second road is divided into two or more third lanes at a third direction and two or more fourth lanes at a fourth direction opposite but parallel to the third direction. The traffic system includes a set of traffic lights and a controller. The controller controls the set of traffic lights and is configured to control traffic movements in the intersection by allocating traffic passing permit to both the pedestrian traffic and vehicle traffic. When the controller is configured to permit pedestrian traffic along the first and the second direction, the controller is configured to permit through vehicle traffic along the first direction and the second direction, and to prohibit turn traffic at any of the first, second, third, and fourth directions.

Other aspects of the present disclosure can be understood by those skilled in the art in light of the description, the claims, and the drawings of the present disclosure.

DETAILED DESCRIPTION

Reference will now be made in detail to exemplary embodiments of the invention, which are illustrated in the accompanying drawings. Wherever possible, the same reference numbers will be used throughout the drawings to refer to the same or like parts.

Figure 1:
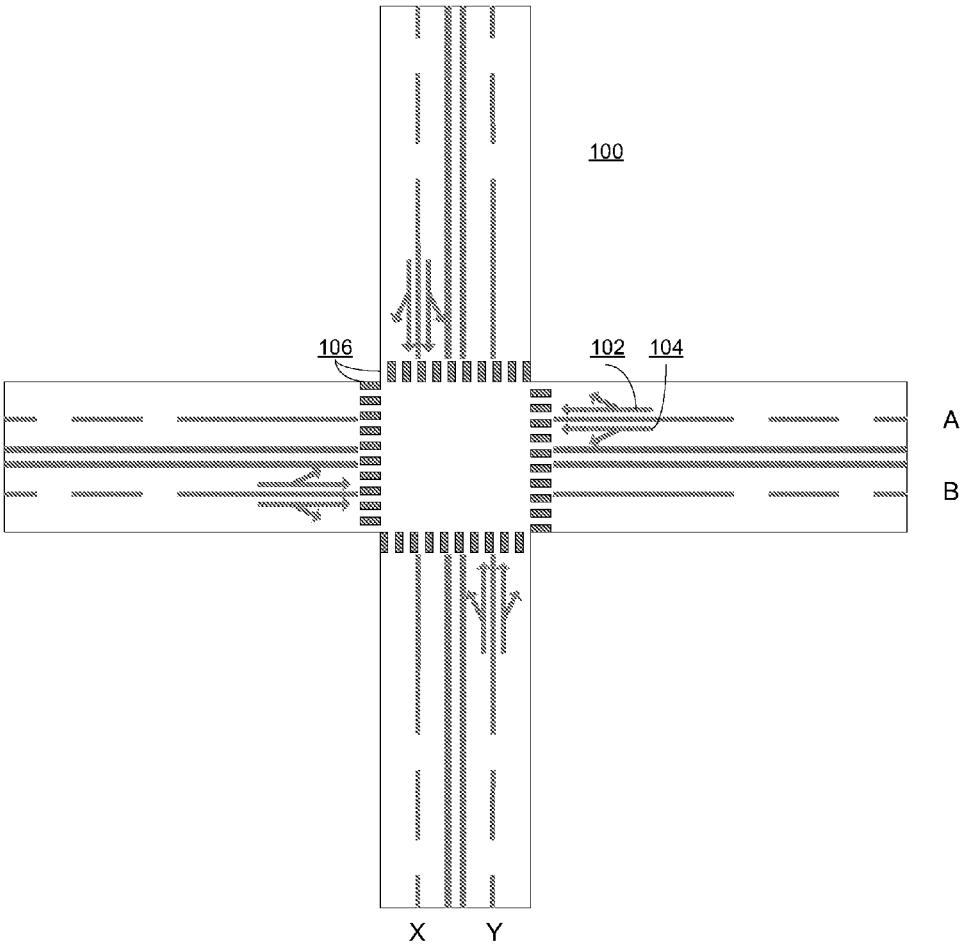
Fig. 1 (Prior Art)
FIG. 1 illustrates an overview of a traditional traffic system.
Figure 2:
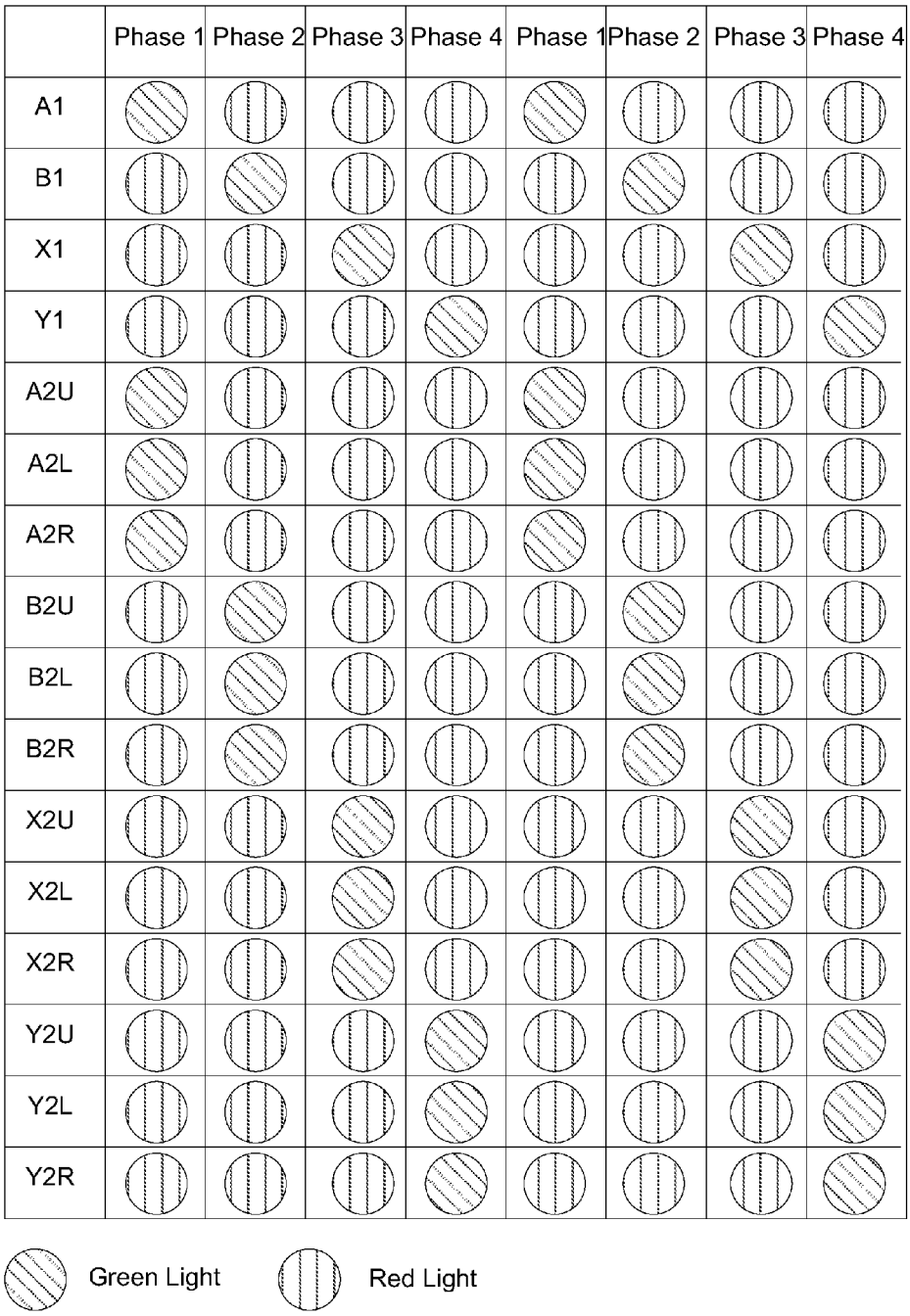
Fig. 2 (Prior Art)
FIG. 2 illustrates traffic signal phases in traditional traffic system.
Figure 3:
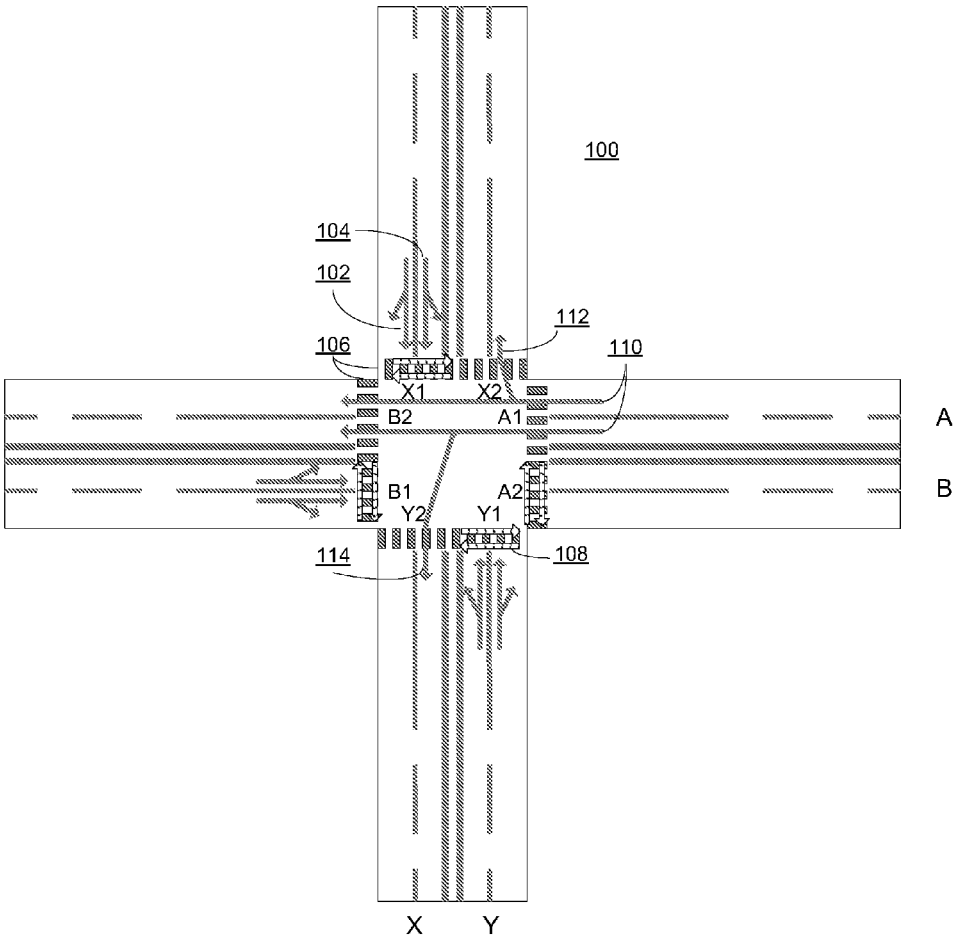
Fig. 3 (Prior Art)
FIG. 3 illustrates the traffic movement of the first phase in a traditional traffic system.
Figure 4:
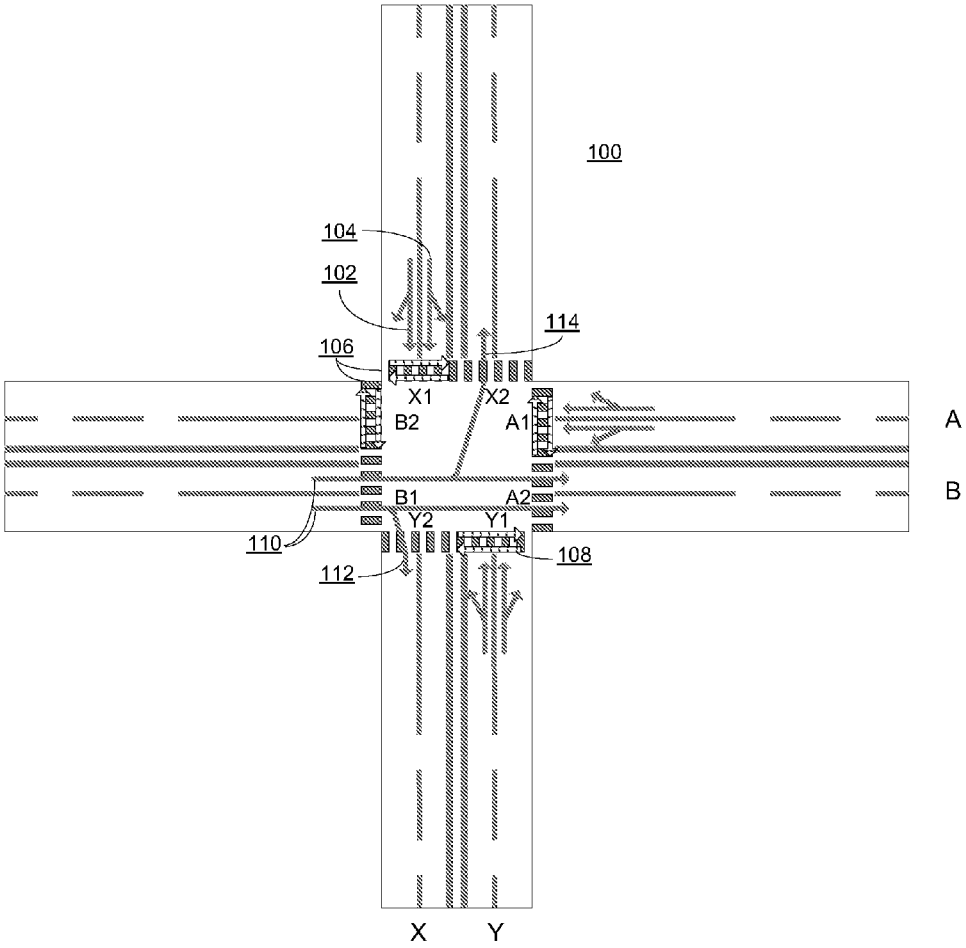
Fig. 4 (Prior Art)
FIG. 4 illustrates the traffic movement of the second phase in a traditional traffic system.
Figure 5:
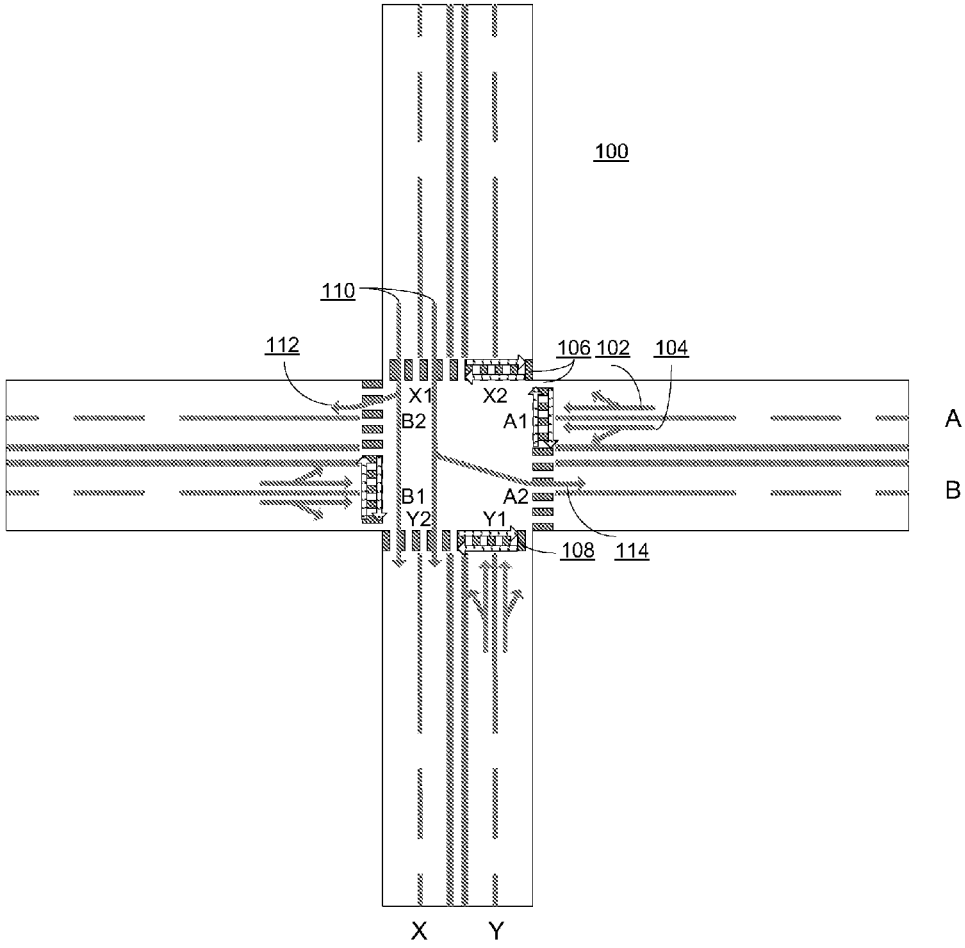
Fig. 5 (Prior Art)
FIG. 5 illustrates the traffic movement of the third phase in a traditional traffic system.
Figure 6:
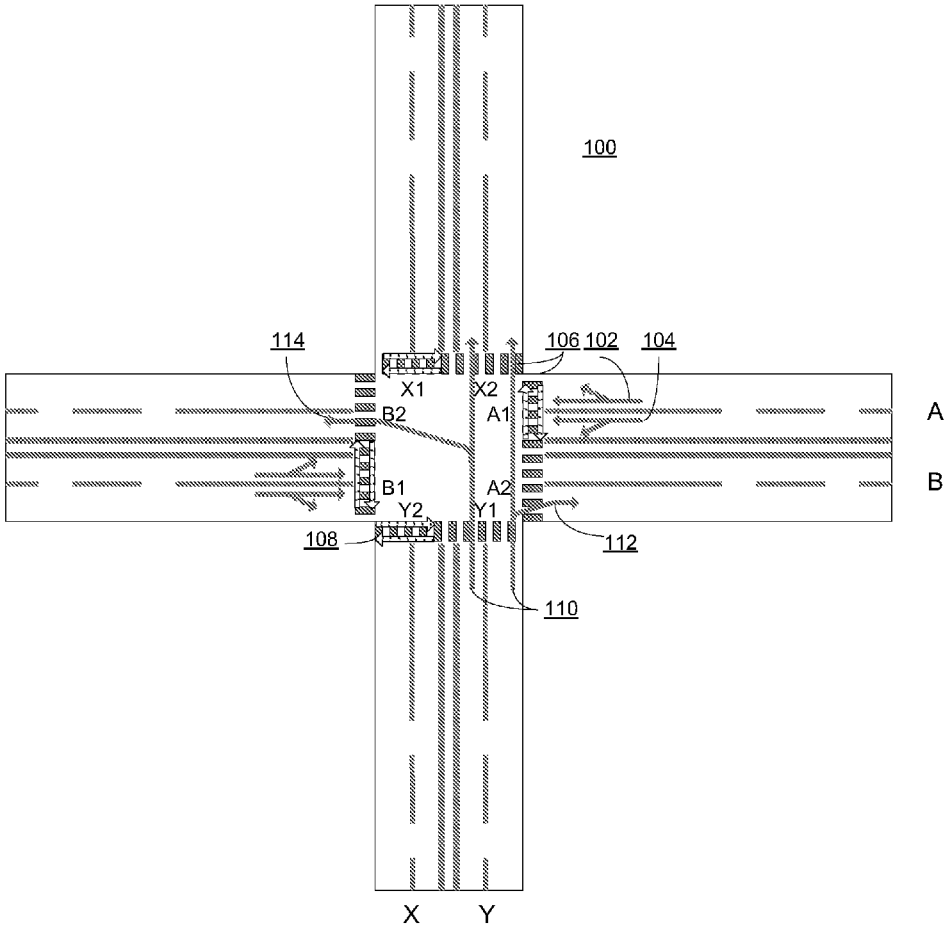
Fig. 6 (Prior Art)
FIG. 6 illustrates the traffic movement of the fourth phase in a traditional traffic system.
Figure 7:
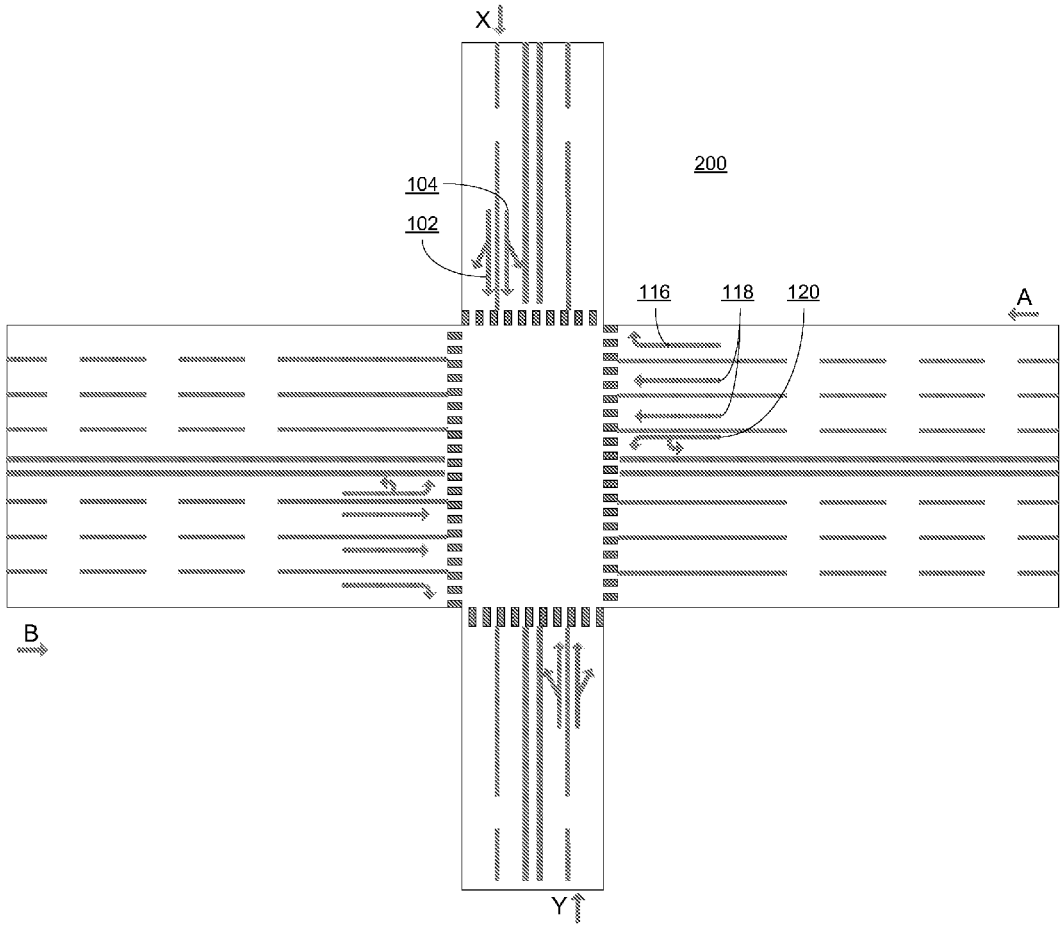
Fig. 7 (Prior Art)
FIG. 7 illustrates an overview of another traditional traffic system.
Figure 8:
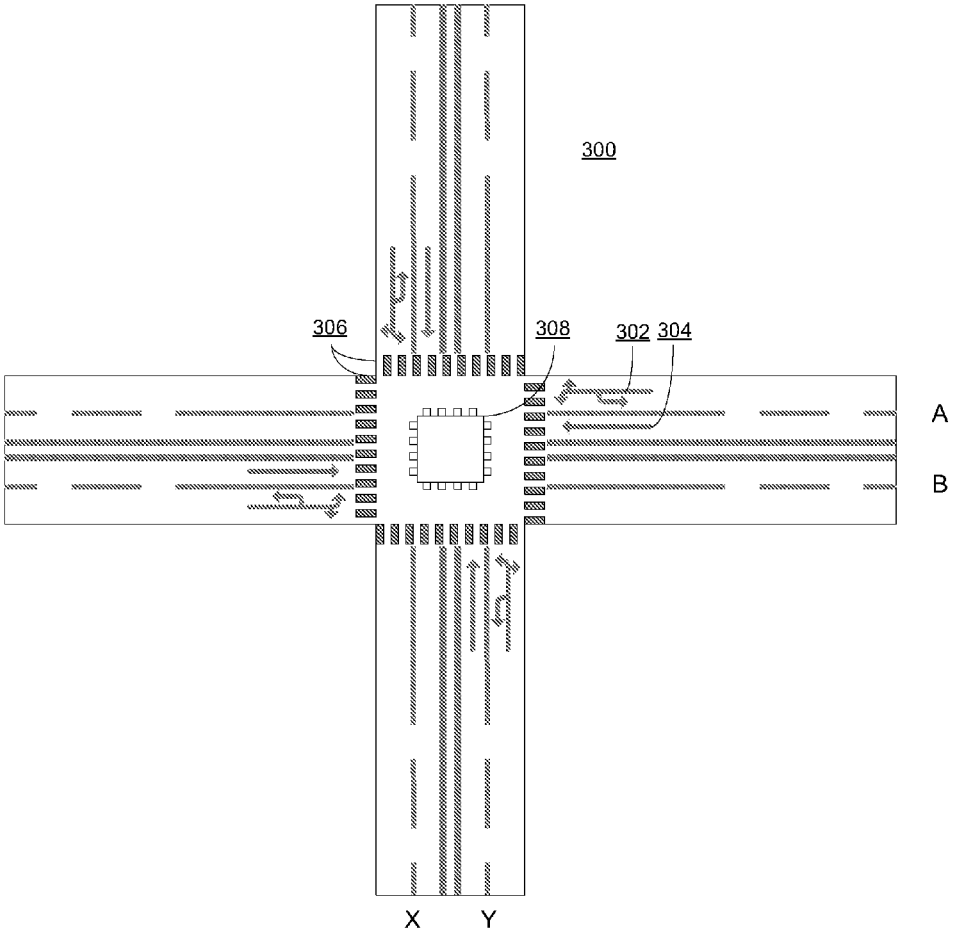
FIG. 8 illustrates an overview of an exemplary enhanced traffic system consistent with the disclosed embodiments.

The present disclosure provides a traffic system for allocating traffic resources and directing safe and efficient traffic movement in an intersection. FIG. 8 illustrates an exemplary traffic system 300 consistent with the disclosed embodiments.

As shown in FIG. 8, traffic system 300 is provided in an intersection where the Roads AB and XY intersect. The traffic system 300 includes a traffic light system 308, which includes four sets of traffic lights facing the Roads A, B, X, and Y. The traffic system 300 also includes a traffic space allocation system, which may include turn traffic marking 302 and through traffic marking 304 on Roads A, B, X, and Y, and markings on pedestrian cross line 306. The through traffic markings 304 are located on the innermost lane, while the turn marking 302, which combines right, left, and U turn markings, is located on the outer lane of the two-lane road (e.g., a curb lane).

That is, for intersection traffic, there may be four different traffic needs: through, U turn, left turn, and right turn. However, under the traffic system 300, there may be only two types of traffic: through traffic and turn traffic. The turn traffic may include any types of turn movements: U turn, left turn, and right turn. Further, lanes are divided into two different types of lanes using traffic markings and/or traffic lights: a through lane(s) and a turn lane(s). For example, an innermost lane (left lane) may be designated for through traffic only; and an outer lane (right lane) may be designated for turn traffic only.

The markings may be configured to provide instructions to the driver. For example, the markings may be placed on the surface of the road, or the markings may be placed on a roadside board instead of the surface of the road. The traffic system 300 may also use both roadside board markings and road surface markings. The number of the markings may be increased or reduced depending on the circumstances of the roads and the intersections. Further, the markings may have different shapes and types such that different types of markings may be used to indicate the allocation of the lanes according to the local standards.

Figure 9:
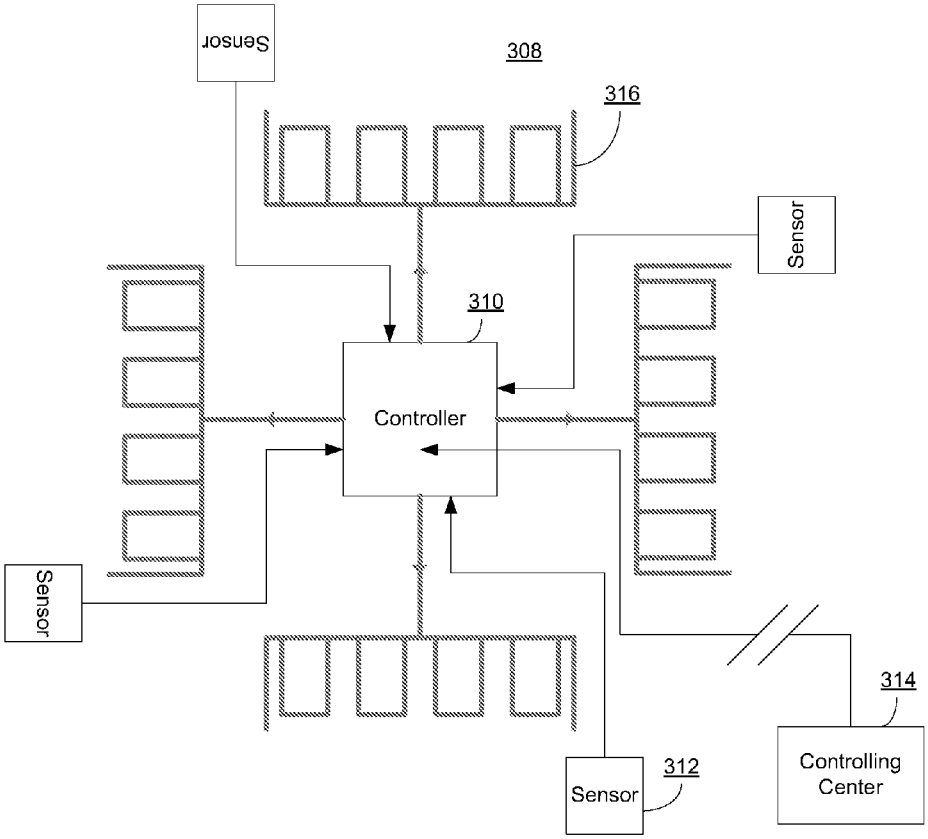
FIG. 9 illustrates an exemplary traffic light system consistent with the disclosed embodiments.

The traffic system 300 also includes a passing permit allocation system, such as a traffic light system. FIG. 9 illustrates an exemplary traffic light system 308 consistent with the disclosed embodiments. As shown in FIG. 9, the traffic light system 308 may include a controller 310, a plurality of traffic lights 316, a plurality of sensors 312, and a controlling center 314. Other components may also be included.

Controller 310 may perform certain control functions of the traffic system 300. Controller 310 may control traffic lights 316 automatically, or may control traffic lights 316 based on information received from sensors 312. Controller 310 may include a processor, such as any appropriate type of graphic processing unit (GPU), general purpose microprocessor, digital signal processor (DSP) or microcontroller, or application specific integrated circuit (ASIC). The controller 310 may also include a memory module, storage media, and input/output devices to complete control functions. Further, controller 310 or the processor of the controller 310 may execute sequences of computer program instructions to perform various processes associated with traffic light system 308 and/or traffic system 300.

Further, controller 310 may also control traffic lights 316 based on information or instructions received from traffic controlling center 314. Traffic controlling center 314 may include any appropriate computer system or server for controlling traffic system 300 including performing certain algorithms to allocate traffic resources and controlling controller 310. Users at the controlling center 314 may also control the traffic system 300. In addition, other programs may also be implemented in the controlling center 314 to analyze information from the controller 310 and to present the results to the user(s). Controlling center 314 may be connected to the controller 310 via any appropriate communication channels, such as wired or wireless communication links.

Figure 10:
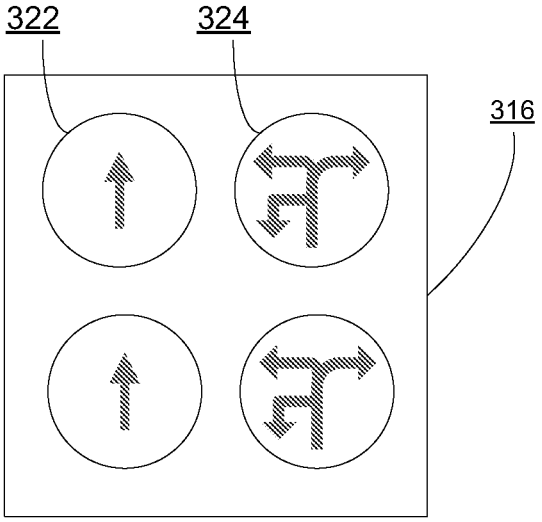
FIG. 10 illustrates an exemplary traffic light set consistent with the disclosed embodiments.

FIG. 10 illustrates an exemplary traffic light set 316. As shown in FIG. 10, a traffic light set 316 may include a through traffic light 322 marked with a straight arrow, and a turn traffic light 324 marked with right, left, and U turn arrows. The through traffic light 322 may include a single light having both red and green colors or two lights of red and green colors respectively, and the turn traffic light 324 may also include a single light having both red and green colors or two lights of red and green colors respectively. Other lights such as pedestrian lights (not shown) may also be included.

The traffic light system 308 may be configured in a variety of ways. The traffic light set 316 may be placed in any position that can provide clear signals to pedestrian and/or vehicle drivers, such as the center of the intersection or the corners of the intersection, etc. The traffic light set 316 may also be configured in certain ways. For example, the through traffic signal and the turn traffic signal may be merged on one light and the traffic movement may be controlled by the particular arrow signal that is turned on. The lights may be arranged horizontally or vertically. The traffic light system 308 may be an automatic system, or a manual system, or an automatic system that can be overridden manually. Further, an independent pedestrian signal light in addition to traffic light set 316 may be used to control the pedestrian traffic. The traffic light system 308 may be used independently or in combination with the road markings consistent with the disclosed embodiment.

Figure 11:
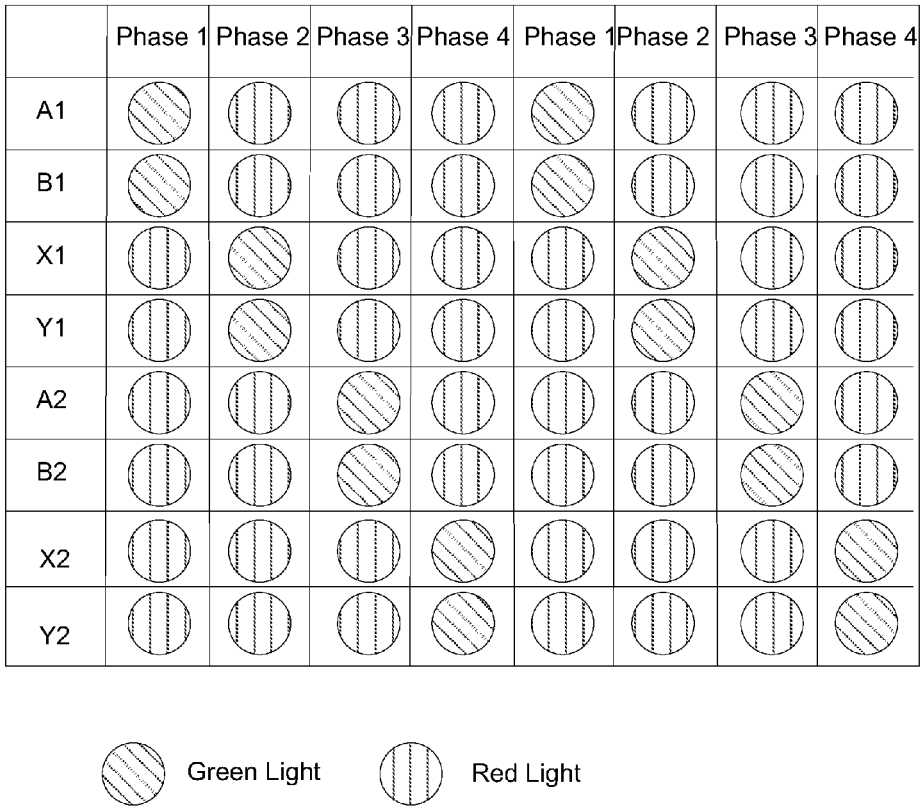
FIG. 11 illustrates exemplary traffic signal phases consistent with the disclosed embodiments.

The traffic light system 308 may be controlled by controller 310 or controlling center 314 to implement a four-phase traffic passing permit allocation. FIG. 11 illustrates an exemplary four-phase traffic passing permit allocation system in an intersection. The four phases of traffic passing permit allocation is also called a traffic allocation cycle.

According to the traffic system 300, all traffic participants may be classified into two basic types, pedestrians and non-pedestrians (e.g., vehicle traffic). Traffic system 300 may control both the pedestrian and non-pedestrian types of traffic such that, when there is a pedestrian traffic permitted, certain vehicle traffic may be prohibited; and when there is a vehicle traffic permitted, certain pedestrian traffic may be prohibited. Controller 310 may control the pedestrian traffic and non-pedestrian traffic by allocating two different types of passing permit: pedestrians permit and vehicle permit.

As shown in FIG. 11, the traffic passing permit allocation system uses four phases to control traffic movements in the intersection. Different number of phases may also be used in a single traffic allocation cycle. Further, only two colors (e.g., red and green) of traffic lights may be used, without the use of a yellow light. The two colors may represent only two types of signals: signals of Yes (green light) and signals of No (red light). That is, the signal of green light means Yes (permitted to proceed) and the signal of red light means No (stop). Other types of signals, such as the signals of yellow light, are not used.

The first phase is allocated to the vehicle through traffic and pedestrian traffic on Road AB. The through traffic lights on Road A and Road B (A1, B1) are green and other vehicle traffic lights are red. The second phase is allocated to the vehicle through traffic and pedestrian traffic on Road XY. The through traffic lights on Road X and Road Y (X1, Y1) are green and other vehicle traffic lights are red. The third phase is allocated to the vehicle turn traffic on Road A and Road B. The turn traffic lights on Road A and Road B (A2, B2) are green and other vehicle traffic lights are red, and the turn traffic lights A2 and B2 are used to signal a single turn traffic along Road A and Road B including A2U, A2L, A2R, B2U, B2L, and B2R. The fourth phase is allocated to the vehicle turn traffic on Road X and Road Y. The turn traffic lights on Road X and Road Y are green (X2, Y2) and other vehicle traffic lights are red, and the turn traffic lights X2 and Y2 are used to signal a single turn traffic on Road X and Road Y including X2U, X2L, X2R, Y2U, Y2L, and Y2R. The details of each traffic allocation phase are described below.

Figure 12:
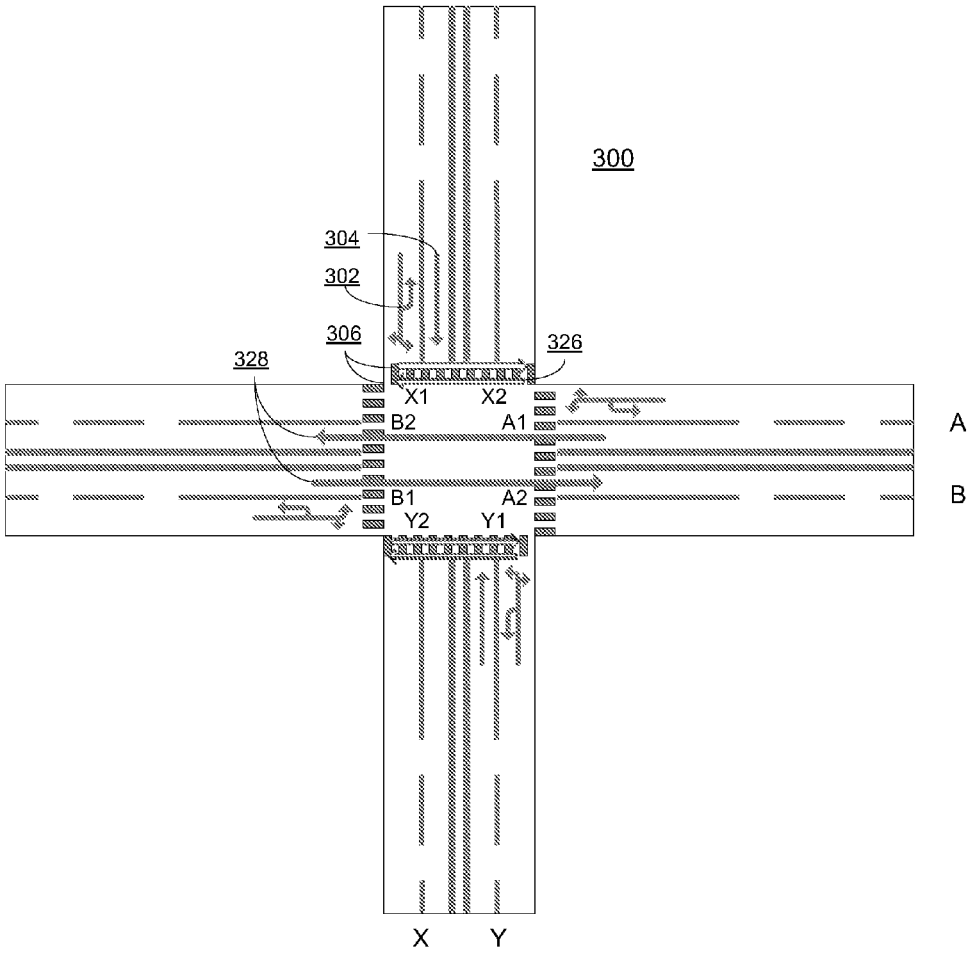
FIG. 12 illustrates exemplary traffic movements during the first phase consistent with the disclosed embodiments.

FIG. 12 illustrates traffic movements during the first phase. As shown in FIG. 12, A1, A2, B1, B2, X1, X2, Y1, and Y2 are the traffic lights in the traffic system 300. During the first phase, the vehicle through traffic 328 (A1, B1) and the pedestrian traffic 326 on both directions of Road AB proceed without interference from other traffic. Other vehicle traffics, such as turn traffic on both Roads AB and XY and through traffic in non-parallel directions, are not permitted. The pedestrian traffic 326 is permissible along the whole length of the pedestrian cross lines 306 on Road AB from both directions.

Figure 13:
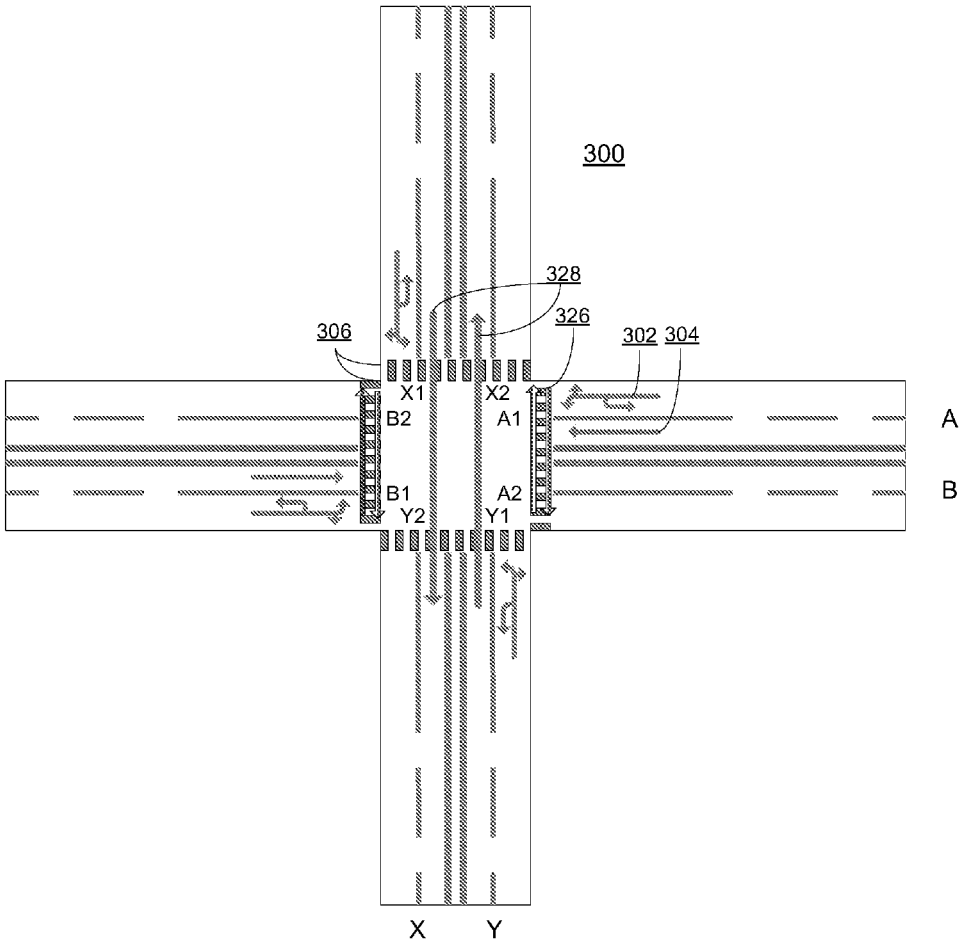
FIG. 13 illustrates exemplary traffic movements during the second phase consistent with the disclosed embodiments.

FIG. 13 illustrates traffic movements during the second phase. As shown in FIG. 13, during the second phase, the vehicle through traffic 328 (X1, Y1) and the pedestrian traffic 326 on both directions of Road XY proceed without interference from other traffic. Other vehicle traffics, such as turn traffic on both Roads AB and XY and through traffic in non-parallel directions, are not permitted. The pedestrian traffic 326 is permissible along the whole length of the pedestrian cross lines 306 on Road XY from both directions.

Figure 14:
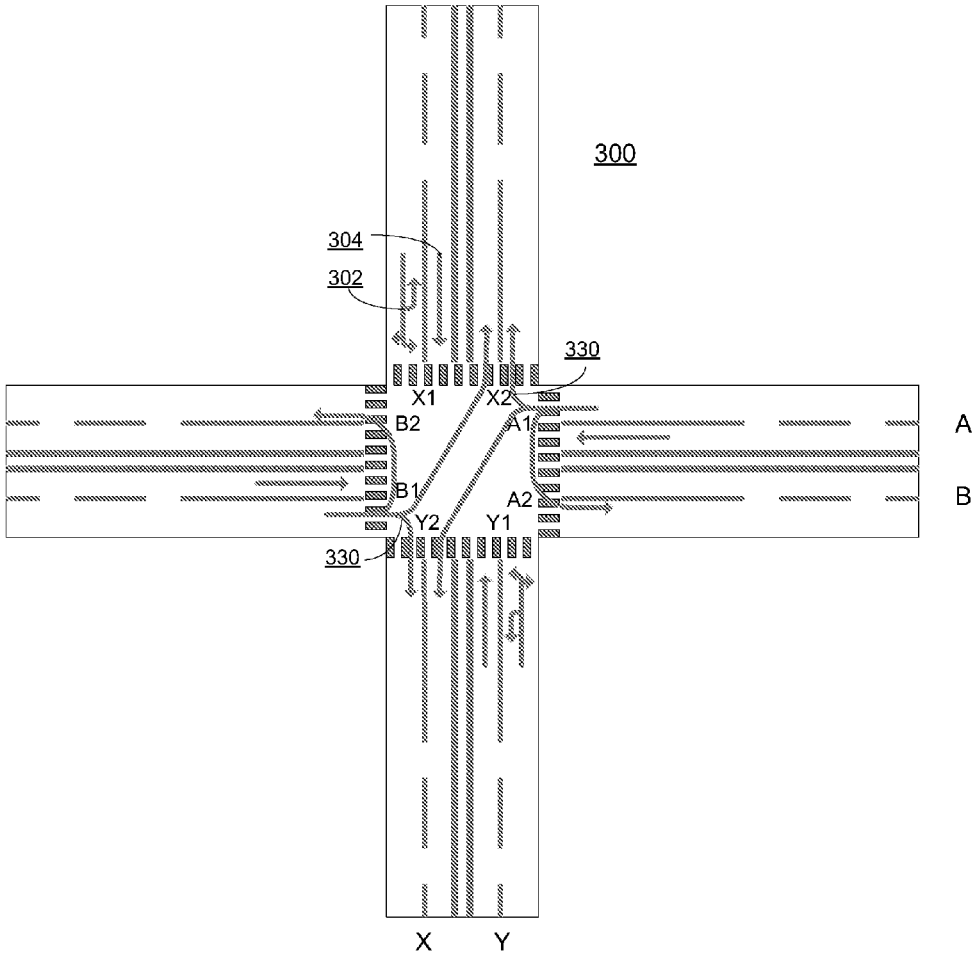
FIG. 14 illustrates exemplary traffic movements during the third phase consistent with the disclosed embodiments.

FIG. 14 illustrates traffic movements during the third phase of traffic allocation according to the disclosed embodiments. As shown in FIG. 14, during the third phase, the vehicle turn traffics 330 (A2, B2 or A2U, A2L, A2R, B2U, B2L, B2R) on both directions of Road A and Road B are permitted. Other traffics, such as through traffic on both Roads AB and XY and turn traffic on Road X and Y, are not permitted. Because, as previously described, the lanes are divided into a through lane and a turn lane, the turn traffic on Road A and Road B can proceed without interference from each other. For example, the left turn traffic from Road A and Road B onto Road X and Road Y can take the through lanes and the right turn traffic from Road A and Road B onto Road X and Road Y can take the turn lanes to avoid conflict. Also, U turn traffic in a two-lane setting can be permitted without any conflict. During this phase, pedestrian traffic is not permitted.

Figure 15:
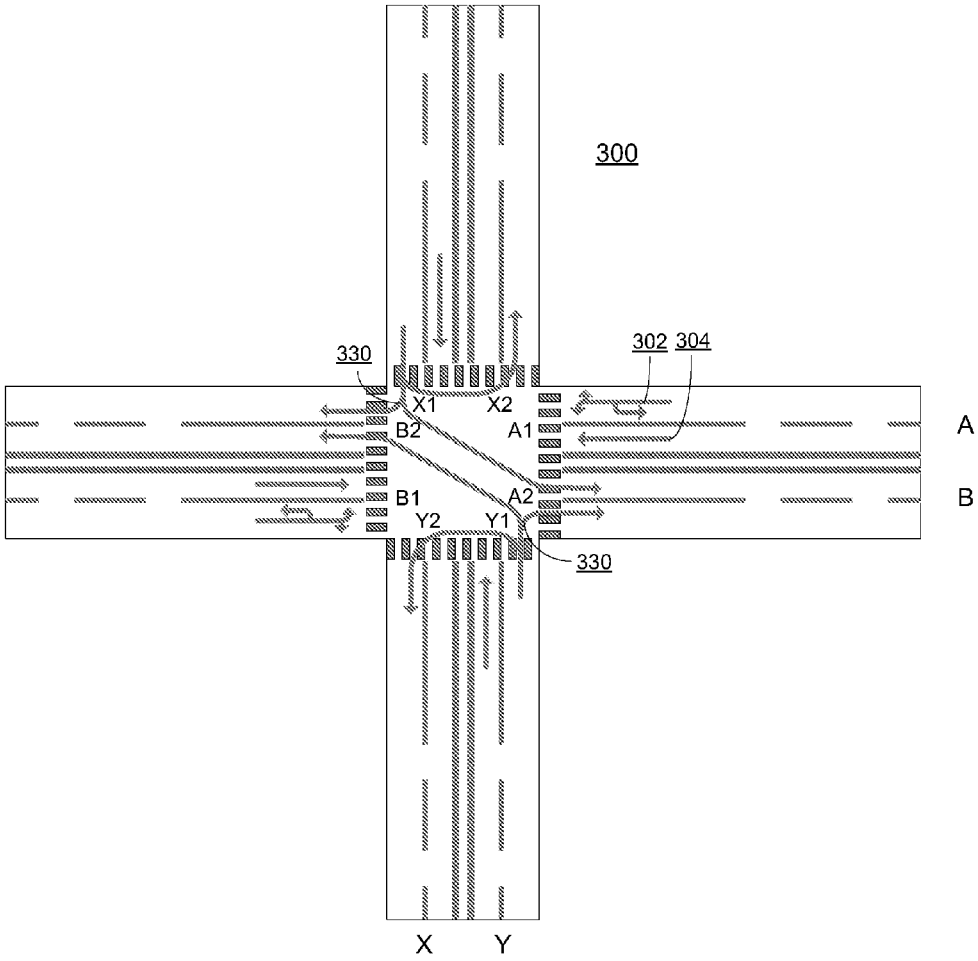
FIG. 15 illustrates exemplary traffic movements during the fourth phase consistent with the disclosed embodiments.

FIG. 15 illustrates traffic movements during the fourth phase of traffic allocation according to the disclosed embodiments. As shown in FIG. 15, during the fourth phase, the vehicle turn traffics 330 (X2, Y2 or X2U, X2L, X2R, Y2U, Y2L, Y2R) on Road X and Road Y are permitted. Other traffics, such as through traffic on both Roads AB and XY and turn traffic on Road A and B, are not permitted. Because the lanes are divided into a through lane and a turn lane, the turn traffic on Road X and Road Y can proceed without interference from each other. For example, the left turn traffic on Road X and Road Y onto Road A and Road B can take the through lanes and the right turn traffic on Road X and Road Y Road A and Road B can take the turn lanes to avoid conflict. U turn traffic can also be permitted without any conflict. During this phase, pedestrian traffic is not permitted.

With respect to the pedestrian traffic, during the four phases of the traffic allocation, the passing permit of the pedestrian traffic is in parallel with the passing permit of the through traffic such that the security and efficiency of the pedestrian traffic can be ensured. More specifically, when there is a permit of pedestrian traffic, vehicle traffic of parallel direction is also permitted; any other vehicle traffic (any turn traffic and through traffic not parallel to the pedestrian traffic) is not permitted. Similarly, when there is a permit of turn vehicle traffic, pedestrian traffic is not permitted; when there is a permit of through vehicle traffic, pedestrian traffic in the parallel direction is permitted and the pedestrian traffic not in parallel direction is not permitted.

Figure 16:
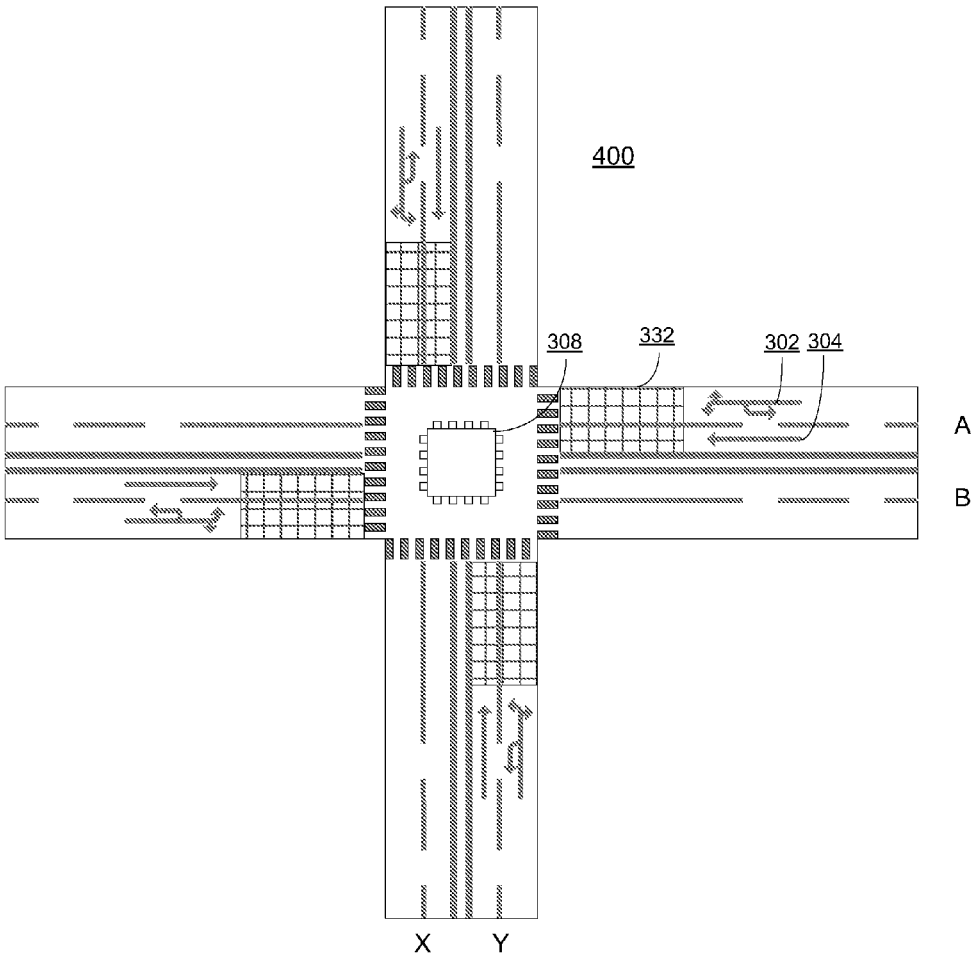
FIG. 16 illustrates another exemplary traffic system with a controlled zone consistent with the disclosed embodiments.

Returning to FIG. 11, additionally or optionally, traffic light system 308 may configure the light signals for traffic passing permit into two states, a stable state and a flashing state. Other number of states may also be used. The traffic light in the stable state is for all traffic; while the traffic light in the flashing state may only for traffic meeting certain condition(s). For example, a controlled zone may be allocated on each of the Road A, B, X, and Y such that the traffic light in the flashing state may be used together with the controlled zones to signal vehicles inside and/or outside individual controlled zones of Road A, B, X, and Y. FIG. 16 illustrates an exemplary traffic system 400 using controlled zones 332 and different traffic light states. The controlled zones may be painted in a color, such as yellow or white, to contrast with road surface.

As shown in FIG. 16, a controlled zone 332 is allocated on each of Road A, B, X, and Y connecting the intersection of Roads AB and XY. Traffic light signals may then be used together with the controlled zones 332. For example, the signal of green light may have two states, green light in stable state and green light in flashing state. The green light in the stable state is a green light for all vehicles and all vehicles are permitted to proceed, and the green light in the flashing state is still a green light but only vehicles in a corresponding controlled zone 332 are permitted to proceed, while vehicles not in the corresponding controlled zone 332 are required to stop behind controlled zone 332. In certain other embodiments, the vehicles may also stop behind the intersection under the green light in the flashing state.

Further, the signal of red light may have two states, red light in stable state and red light in flashing state. The red light in the stable state is a red light for all vehicles and all vehicles are required to stop, and the red light in the flashing state is still a red light but the signal of a flashing red light indicates that red light is going to turn to green light shortly and vehicles behind a corresponding controlled zone are required to enter the controlled zone 332 and be ready to pass the intersection when the green light is present. The length of the controlled zone 332 may be so configured that a vehicle entering the controlled zone 332 while red light flashes would not pass through the controlled zone 332 until the traffic light signal becomes green. Other configurations of the controlled zone 332 may also be used.

Figure 17:
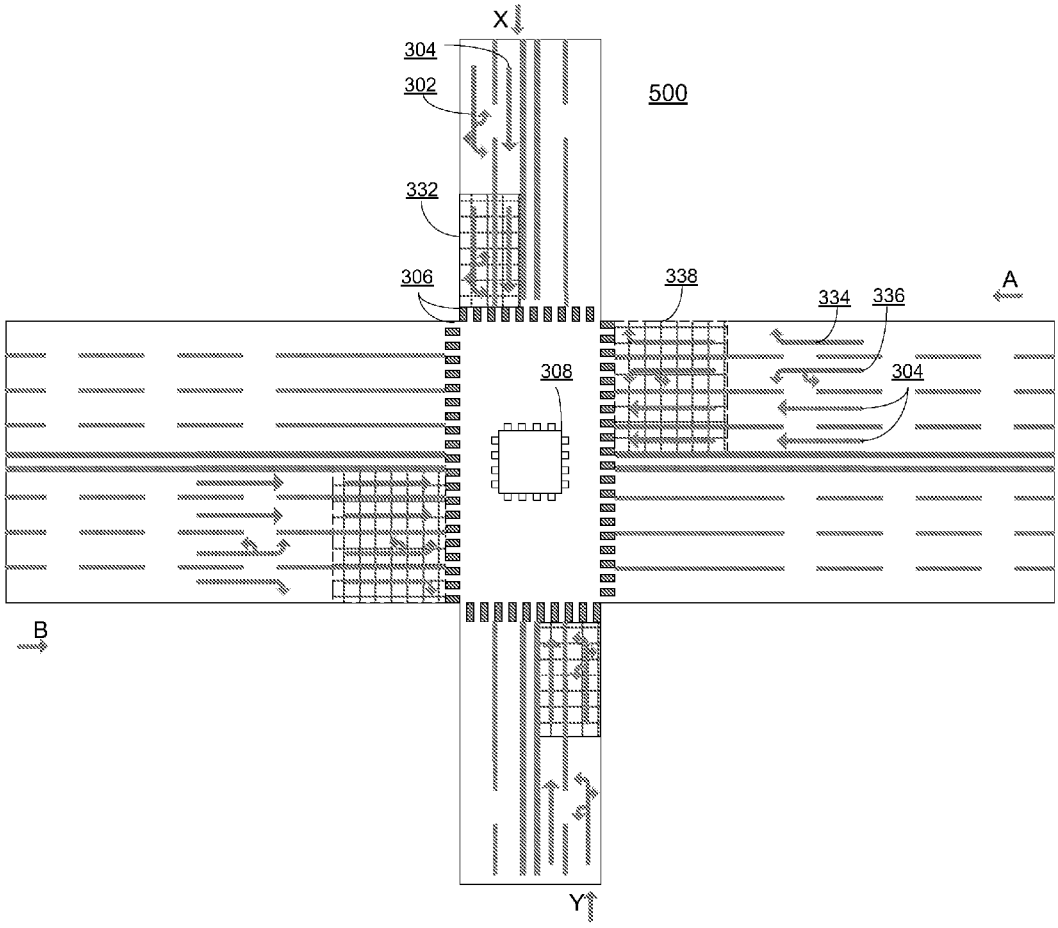
FIG. 17 illustrates another exemplary traffic system with the controlled zone consistent with the disclosed embodiment.

FIG. 17 illustrates another exemplary traffic system 500. As shown in FIG. 17, the traffic system 500 is similar to the traffic system 300 in FIG. 8. However, the Road A and Road B both include 4 lanes instead of two lanes. Any number of lanes may be included in Road A, B, X, and/or Y.

The traffic system 500 may include traffic light system 308, through traffic markings 304 on Roads A, B, X, and Y, turn traffic markings 302 on Roads X and Y, turn traffic markings 334 and 336 on Roads A and B, controlled zones 332 on Road XY; and controlled zones 338 on Road AB. Because Road AB has four lanes, the through traffic markings 304 are located at the inner two lanes of Road A and B, the right turn traffic marking 334 is located at the right lane (the outer-most lane) of Road A and B, and the left turn and U turn marking 336 is located at the second-outer-most lane. On the other hand, Road XY still has two lanes, the traffic markings on Road XY may remain unchanged from traffic system 300. That is, the turn marking 302, which combines right, left, and U turn markings, is located on the curb lane, and the through traffic marking 304 is located at the innermost lane.

Further, controlled zones 332 and 338 may be allocated at the end connected to the intersection on each of Road A, B, X, and Y. Each road may have two sets of through and turn traffic markings, with one set traffic markings in the controlled zone and the one set of markings on the road behind the controlled zone. Other configurations may also be used.

By using the disclosed methods and systems, advantageous traffic resource allocation systems may be implemented to control the traffic movements in an intersection and complete vehicle traffic needs may be supported. For example, vehicles can be permitted to make U turn at intersections, which is a great saving of time and journey compared the prohibition of U turn under traditional traffic resources allocation. Because there is no conflict between pedestrians and vehicles, all traffic participants may adopt reasonable high speed to pass at intersections.

The drivers of through lanes may be benefited from the disclosed methods and systems in that, when a through traffic is permitted, the permitted through lane is always clear ahead. Thus, the drivers of through lanes may enjoy a quicker passing. Pedestrians are also benefited from the disclosed methods and systems as pedestrians now facing no conflicts with turn traffic and the only moving vehicles are at distance of at least one lane away and such vehicles are moving at a parallel direction. Furthermore, the disclosed methods and systems add a controlled zone and vehicles may stop behind controlled zone which adds a large distance between pedestrians and vehicles. In addition, the disclosed methods and systems also support continuous green light therefore emergency vehicle may save substantial waiting time.

In other words, the disclosed methods and systems may offer certain advantages over the traditional system both in safety and efficiency through optimized allocation of space and time at an intersection. The pedestrian and vehicle through traffic on the same road may pass the intersection at the same time without interfering with each other, i.e., the pedestrian traffic and vehicle traffic are separated in space. As a result, the risk of collision between pedestrians and vehicles in the intersection is substantially reduced and both pedestrians and vehicles can pass the intersection with reasonable high speed. Further, the allocation of turn traffic to the lanes closer to the curb provides greater maneuver space for vehicles to turn at the intersection. U turn, therefore, is practical in most intersections, while in traditional system, U turn is generally impermissible on narrower roads. In addition, greater maneuver space means greater safety for the vehicle in motion.

Further, the allocation of controlled zones and the flashing light states increases the safety as well. The controlled zones may also provide extra distance between stopped vehicles and pedestrians in the cross walk. The flashing light may provide warning to the pedestrians and vehicles that the present traffic signal is about to expire and the pedestrians and vehicles are provided extra time to prepare for the next step of action.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications. For example, the traffic system according to the present disclosure can be used in intersections where a road with one or two or three or four or more lanes crosses a road with one or two or three or four or more lanes.

What is claimed is:

1. A traffic resource allocation method for allocating traffic resources around an intersection formed by a first road and a second road, the method comprising:

dividing the first road into two or more first lanes at a first direction and two or more second lanes at a second direction opposite but parallel to the first direction;

dividing the second road into two or more third lanes at a third direction and two or more fourth lanes at a fourth direction opposite but parallel to the third direction; and controlling traffic movements in the intersection by allocating traffic passing permit to both pedestrian traffic and vehicle traffic on the first road and the second road, when permitting pedestrian traffic along the first direction and the second direction, permitting through vehicle traffic along the first direction and the second direction, and prohibiting turn traffic at any of the first, second, third, and fourth directions.

2. The traffic resource allocation method according to claim 1, further including:

prohibiting through vehicle traffic along the third direction and the fourth direction; and prohibiting pedestrian traffic along the third direction and the fourth direction.

3. The traffic resource allocation method according to claim 1, when permitting through vehicle traffic along the first direction and the second direction, permitting pedestrian traffic along the first direction and the second direction, and prohibiting turn traffic at any of the first, second, third, and fourth directions.

4. The traffic resource allocation method according to claim 3, further including:

prohibiting through vehicle traffic along the third direction and the fourth direction; and prohibiting pedestrian traffic along the third direction and the fourth direction.

5. The traffic resource allocation method according to claim 1, when permitting turn traffic from the first direction and turn traffic from the second direction, prohibiting pedestrian traffic at any of the first, second, third, and fourth directions.

6. The traffic allocation method according to claim 5, further including:

prohibiting through vehicle traffic at any of the first, second, third, and fourth directions, and prohibiting turn traffic from the third direction and turn traffic from the fourth direction.

7. The traffic resource allocation method according to claim 1, wherein:

only two colors, a first color and a second color, of traffic light are used to respectively signal permitting and prohibiting traffic at the intersection.

8. The traffic resource allocation method according to claim 7, further including:

allocating a controlled zone from the intersection at each of the first direction, the second direction, the third direction, and the fourth direction.

9. The traffic resource allocation method according to claim 8, wherein:

the first color of traffic light is in one of a stable state and a flashing state; and when the first color of traffic light is in the flashing state, vehicles in corresponding controlled zones are permitted to proceed, and vehicles not in the corresponding controlled zones are required to stop behind the controlled zones.

10. The traffic resource allocation method according to claim 8, wherein:

the second color of traffic light is in one of a stable state and a flashing state; and when the second color of traffic light is in the flashing state, vehicles behind the corresponding controlled zones are required to enter the corresponding controlled zones.

11. The traffic resource allocation method according to claim 1, further including:

marking the first lanes, the second lanes, the third lanes, and the fourth lanes, respectively, as one or more through lanes and one or more turn lanes, wherein the turn lanes combine the functions of at least two of a left turn, a right turn, and a U turn through the intersection.

12. The traffic resource allocation method according to claim 11, wherein:

the one or more through lanes are innermost lanes of the first lanes, the second lanes, the third lanes, or the fourth lanes.

13. A traffic system for allocating traffic resources around an intersection formed by a first road and a second road, wherein the first road is divided into two or more first lanes at a first direction and two or more lanes at a second direction opposite but parallel to the first direction and the second road is divided into two or more third lanes at a third direction and two or more lanes at a fourth direction opposite but parallel to the third direction, the traffic system comprising:

a set of traffic lights; and a controller controlling the set of traffic lights being configured to control traffic movements in the intersection by allocating traffic passing permit to both the pedestrian traffic and vehicle traffic, when the controller is configured to permit pedestrian traffic along the first direction and the second direction, the controller being configured to permit through vehicle traffic along the first direction and the second direction, and to prohibit turn traffic at any of the first, second, third, and fourth directions.

14. The traffic system according to claim 13, wherein the controller is further configured to prohibit through vehicle traffic along the third direction and the fourth direction; and pedestrian traffic along the third direction and the fourth direction.

15. The traffic system according to claim 13, when the controller is configured to permit through vehicle traffic along the first direction and the second direction, the controller being configured to permit pedestrian traffic along the first direction and the second direction, and to prohibit turn traffic at any of the first, second, third, and fourth directions.

16. The traffic system according to claim 15, wherein the controller is further configured to prohibit through vehicle traffic along the third direction and the fourth direction; and pedestrian traffic along the third direction and the fourth direction.

17. The traffic system according to claim 13, when the controller is configured to permit turn traffic from the first direction and turn traffic from the second direction, the controller being configured to prohibit the pedestrian traffic at any of the first, second, third, and fourth directions.

18. The traffic system according to claim 17, the controller is further configured to:

prohibit through vehicle traffic at any of the first, second, third and fourth directions; and prohibit turn traffic from the third direction and turn traffic from the fourth direction.

19. The traffic system according to claim 13, wherein:

the traffic light set only uses two colors, a first color and a second color, of traffic light are used to respectively signal permitting and prohibiting traffic at the intersection.

20. The traffic system according to claim 19, wherein:

a controlled zone is allocated from the intersection at each of the first direction, the second direction, the third direction, and the fourth direction.

21. The traffic system according to claim 20, wherein:

the first color of traffic light is in one of a stable state and a flashing state; and when the first color of traffic light is in the flashing state, the controller signals vehicles in corresponding controlled zones as being permitted to proceed, and vehicles not in the corresponding controlled zones as being required to stop behind the controlled zones.

22. The traffic system according to claim 20, wherein:

the second color of traffic light is in one of a stable state and a flashing state; and when the second color of traffic light is in the flashing state, the controller signals vehicles behind the corresponding controlled zones as being required to enter the corresponding controlled zones.

23. The traffic system according to claim 13, wherein, the first lanes, the second lanes, the third lanes, and the fourth lanes are configured to have one or more through lanes and one or more turn lanes, wherein the turn lanes combine the function of at least two of a left turn, a right turn, and U turn.

24. The traffic system according to claim 23, wherein:

innermost lanes of the first lanes, the second lanes, the third lanes, or the fourth lanes are configured as the one or more through lanes.

* * * * *